United States Patent [19]

Morana

[11] 4,201,068

[45] May 6, 1980

[54] COMBINATION LOCK

[76] Inventor: Luis Morana, Paraguay 3074, 3000 Ciudad de Santa Fe, Argentina

[21] Appl. No.: 960,651

[22] Filed: Nov. 14, 1978

[51] Int. Cl.[2] ..... E05B 37/04; E05B 37/02

[52] U.S. Cl. ..... 70/310; 70/311

[58] Field of Search ..... 70/310, 311, 304, 312, 70/321, 322, 329

[56] References Cited

U.S. PATENT DOCUMENTS

| | | | |
|---|---|---|---|
| 1,263,062 | 4/1918 | Ikeda | 70/310 |
| 1,464,281 | 8/1923 | Jay | 70/310 |
| 1,752,824 | 4/1930 | Watson | 70/311 |
| 3,196,643 | 7/1965 | Moss | 70/311 |
| 4,064,718 | 12/1977 | Cowen | 70/311 |

*Primary Examiner*—Robert L. Wolfe

*Attorney, Agent, or Firm*—John J. Byrne

[57] ABSTRACT

A combination lock having a box inside which is located a sliding latch having a ratchet operated by a pinion operated from outside. The pinion being slidable to enter a round hole in a plurality of rotating members operating as a coding device, the pinion being adapted to rotate only when it is in said round holes. The combination members have the remaining holes of a section that blocks the pinion rotation so that only when all the combination members offer their circular holes is possible to rotate the pinion and so operate the latch.

4 Claims, 4 Drawing Figures

4
10
7
13
11
12
14
2

COMBINATION LOCK

This invention refers to locks in general and more particularly it refers to a combination lock. Its main object is to provide a novel mechanism designed to be manufactured at a markedly reduced cost compared to any other combination lock adapted to provide a safety degree as in the embodiment to be disclosed.

In addition to the cost advantages of this novel lock, it must be realized that its ingenious arrangement enables its manufacture in incredible reduced sizes, so that the application thereof is not limited to the locking of safety boxes and treasuries. In fact, it may be embodied in small locks for portfolios or wallets and even for pockets in wearing apparel.

Generally speaking, this lock includes a latch and a locking device for the latch, said locking device being adapted to be used at will by the user, so that it forbids the use of the lock to all those that do not know the latch operating mechanism, the means forming the assembly being so arranged and designed that it is not possible to find the unlocked position by trial and error.

To provide the above objects, this lock comprises a mechanism supporting box, through said box projecting the latch provided with a section having successive channels arranged as ratchet teeth geared to a pinion adapted to be operated through a rod from the outside of said box. Said pinion and the related rod, being axial and angularly movable, are guided by a bushing that, inside the box, has a cross section blocking the pinion rotation, provided that said pinion is within that section thanks to its axial displacement. On the other hand, said box is provided with a disc assembly, each one of said discs being commanded from the outside through a shaft, so that they form a telescopic system. Each disc has a number of holes equidistant from the rotation center. Only one hole is circular, having a slightly greater diameter than the pinion's outside diameter, while the remaining holes are so shaped that they prevent the rotation of the pinion when passing through the disc assembly.

Then, the lock may be operated only when the pinion is out of the blocking bushing and, besides, going though the discs only when traversing their circular holes. The latter is the combination position of the lock, i.e. the setting that sets free the latch commands.

The rod supporting the pinion at its inner end, may be axially displaced. When it is displaced towards the lock front, the pinion gets inside the blocking bushing, and in this position the discs may be rotated to reach the opening combination. On the contrary, when the rod is displaced towards the lock back, the pinion is not under the control of the blocking bushing and it must pass through the disc assembly. When the pinion passes through the circular holes of all the discs, it is free to rotate, but when some disc is traversed through a hole having a blocking configuration, the pinion cannot be rotated and the latch cannot be displaced.

The above mentioned and other features and objects of this invention and the manner of attaiming them, will become more apparent and the invention it self will be best understood by reference to the following description of an embodiment of the invention taken in conjuntion with the accompanying drawings wherein.

In different figures, the same references have been used for the same or like elements. Letters have been used as references for an assembly of several elements.

Figure 2:
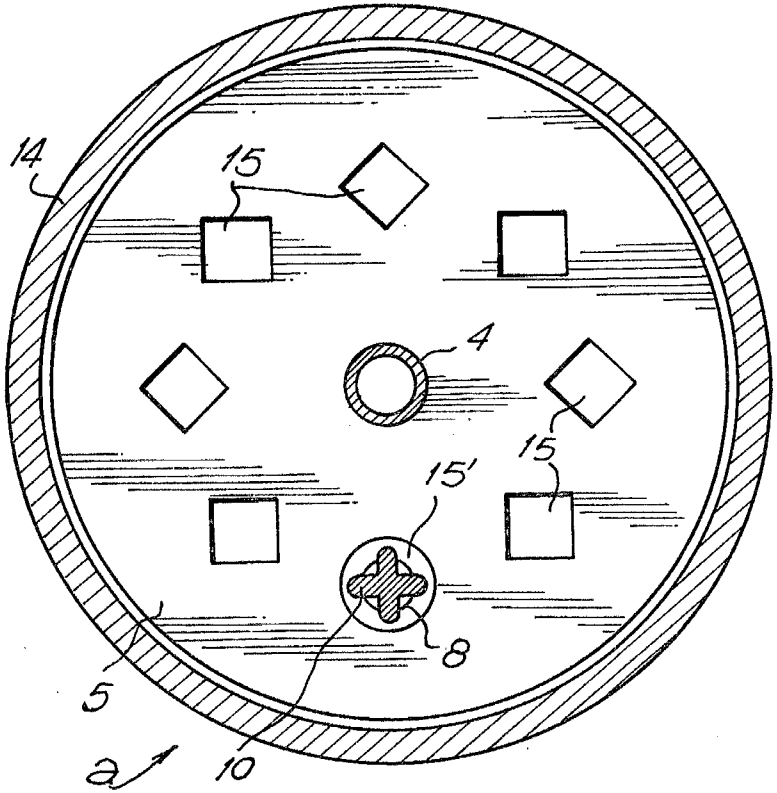
FIG. 2 is a cross section of the same lock taken between two of said discs, following the line A-A, showing that only one hole is circular while the ramaining holes are, in this case, of square shape.
Figure 1:
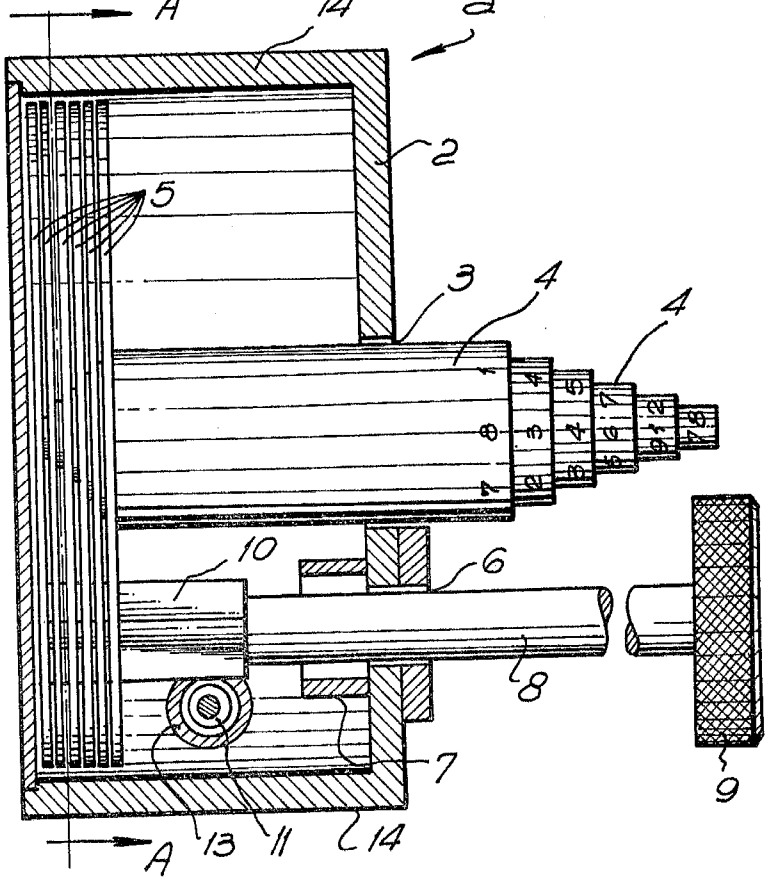
FIG. 1 is a longitudinal section of the lock showing the pinion passing through the circular holes, one of which is provided in each disc, the pinion rotation being allowed in this position. This figure also shows the disc assembly with their respective shafts forming a telescopic system allowing their rotation from outside the box.
Figures 3, 4:
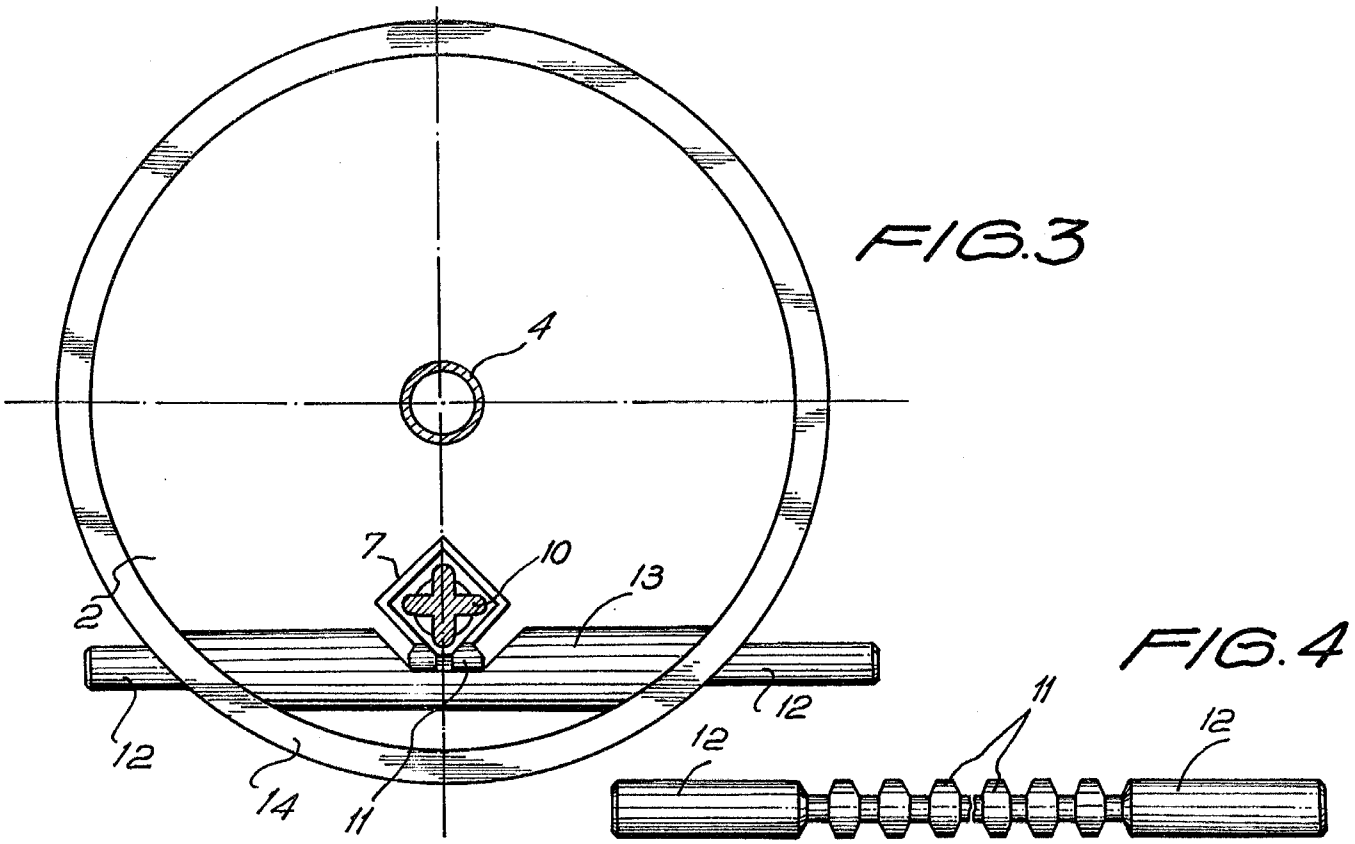
FIG. 3 is a further section at the level of the ratchet type latch, showing that the shape of the blocking bushing is also square, to stop the rotation of a four teeth pinion.
FIG. 4 is a side view of the latch with a section provided with successive circular channels that form the ratchet teeth.

Referring to the drawings, box a has a back cover 1 enabling the mounting of the mechanism inside the box while the front 2 of the box has a central hole 3 through which passes the shaft assembly 4. These shafts are telescopically arranged and individually coupled each one to a respective disc 5.

Said front 2 has a second hole 6 from which inwardly projects the square blocking bushing 7, passing through said second hole. The rod 8 has at its end a manual operating handle 9, while the inner end is toothed in the shape of a four teeth pinion 10.

In spite of the axial displacement that may be effected by the rod 8 together with its pinion 10, said pinion permanently engaged the ratchet 11 provided by the latch 12, the displacement of which is guided through the tube 13 fastened to the cylindrical wall 14 of the box a, so that the latch may protrudge outside the box to effect the required closure according to the use of the lock.

Each one of the discs is provided with a number of holes 15 equally spaced from the center and at the same distance from said center as the rod from the rotation axis of the telescopic assembly. This fact enables the pinion when being axially displaced to go through one hole in each of the discs of assembly 5. Of these holes, those having the reference 15 have a square shape but each one of the discs is provided with a circular shaped hole 15' into which the pinion can be rotated because the diameter of the hole is slightly greater than the pinion outside diameter.

When the latch 12 is in its closing position and the discs are randomly arranged so that they are not in their opening arrangement or aperture combination, the pinion 10 may be axially displaced but cannot be rotated to shift the latch. When displaced towards the box front end, it is introduced into square bushing 7 is blocked, while when displaced towards the box rear end, it gets out of the blocking bushing 7 but gets into a succession of square holes 15 adapted to block its rotation.

To enable the latch to be shifted, the pinion 10 should be displaced inside the bushing 7, rotating the telescopic shafts 4 until the circular holes 15' are coincident with the pinion, so that the latter may be taken out of the blocking bushing, entering into said circular holes so that the bushing can be rotated. The particular shape of the teeth 11 of the latch ratchet is important, comprising a succession of circular channels. The object of this construction is to prevent breaking the latch with a hack saw. In fact the latch will be rotating during such a violation intent while accompanying the alternative movement of the hack saw.

In the disclosed embodiment of this invention, providing six discs having eight holes each, the chance of finding the combination by trial and error is of 1 part in 262,144; while the use of a higher number of thinner discs having a suitable number of holes will provide a combination lock with a remote possibility of opening by trial and error.

The holes 15 may have any other section suitable for their operation. i.e., for hexagonal holes, a six teeth pinion must be used. When pentagonal section holes are used, a five teeth pinion is used. Shapes not related with regular polygons may be used; i.e. having one straight side while the remainder of the perimeter of the section is of an approximately circular shape. In all cases, said discs must be provided with just one circular hole 15' providing a free rotation for the pinion.

While the principles of the invention have been described above in connection with specific apparatus and applications, it is to be understood that this description is made only by way of example and not as a limitation on the scope of the invention.

I claim:

1. New combination lock of the type including a box containing a latch operating and latch blocking mechanism; wherein said latch being formed by a axially movable body is provided with a toothed ratchet like section engaging a pinion located at the end of a rod the opposite end of which is provided with a handle for manual operation located outside said box; in said block being installed a number of laminar bodies which are mounted with a rotating character and have their respective centers joined to respective shafts, said shafts forming a telescopic assembly and having their respective operating sections externally in reference to said box; and each one of said laminar bodies has multiple holes equally separated from the center; one hole of each body being of circular section and having a slightly greater diameter than the pinion external diameter; and the remaining holes of each disc having a section of such shape that allows the pinion ingress but blocks the rotation thereof; said rod being installed in a bushing for blocking said pinion, the cross section of said bushing being adapted to block said pinion rotation.

2. A new combination lock as claimed in claim 1, wherein said pinion is a four teeth pinion, the cross section of said blocking bushing is a squared shaped section and the shape of each pinion blocking holes is a square shape.

3. A new combination lock as claimed in claim 1; wherein said laminar bodies are discs.

4. A new combination lock as claimed in claim 1, wherein said toothed ratchet like section of the latch body is formed by a succession of circular channels.

* * * * *